US011365735B2

(12) United States Patent
Akei

(10) Patent No.: US 11,365,735 B2
(45) Date of Patent: Jun. 21, 2022

(54) INTERNAL DISCHARGE GAS PASSAGE FOR COMPRESSOR

(71) Applicant: Carrier Corporation, Palm Beach Gardens, FL (US)

(72) Inventor: Masao Akei, Cicero, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 106 days.

(21) Appl. No.: 16/758,309

(22) PCT Filed: Oct. 23, 2018

(86) PCT No.: PCT/US2018/057125
§ 371 (c)(1),
(2) Date: Apr. 22, 2020

(87) PCT Pub. No.: WO2019/084019
PCT Pub. Date: May 2, 2019

(65) Prior Publication Data

US 2020/0256337 A1 Aug. 13, 2020

Related U.S. Application Data

(60) Provisional application No. 62/577,001, filed on Oct. 25, 2017.

(51) Int. Cl.
*F04C 18/16* (2006.01)
*F04C 29/12* (2006.01)
(Continued)

(52) U.S. Cl.
CPC ..... *F04C 18/16* (2013.01); *F04C 29/12* (2013.01); *F04C 2210/22* (2013.01)

(58) Field of Classification Search
CPC ..... F04C 18/08; F04C 18/086; F04C 18/16; F04C 29/12; F04C 28/26; F04C 18/06; F04C 18/02; F04C 29/06; F01C 1/16
See application file for complete search history.

(56) References Cited

U.S. PATENT DOCUMENTS 3,112,869 A * 12/1963 Aschoff ..... F04C 18/16 418/87
3,804,565 A * 4/1974 Sennet ..... F04C 2/165 415/99

(Continued)

FOREIGN PATENT DOCUMENTS

CN 102046980 A 5/2011
CN 102076961 A 5/2011

(Continued)

OTHER PUBLICATIONS

International Search Report; International Application No. PCT/US2018/057125; International Filing Date: Oct. 23, 2018; dated Mar. 14, 2019; 7 pages.

(Continued)

*Primary Examiner* — Deming Wan
(74) *Attorney, Agent, or Firm* — Cantor Colburn LLP

(57) ABSTRACT

A compressor casing having an internal gas passage includes a first bearing housing arranged at a first end of the casing, a second bearing housing arranged at a second, opposite end of the casing, and a rotor case disposed between the first bearing housing and the second bearing housing. The rotor case includes an axially extending bore within which a plurality of rotors are receivable and a hollow internal cavity isolated from the bore. The internal cavity is fluidly coupled to the bore via at least one recess. At least one exit opening is formed in one of the first bearing housing and the second bearing housing. The at least one exit opening is operably coupled to the internal cavity of the rotor case.

19 Claims, 7 Drawing Sheets

(51) Int. Cl.

| | |
|---|---|
| ***F04C 28/06*** | (2006.01) |
| ***F04C 18/02*** | (2006.01) |
| ***F04C 29/06*** | (2006.01) |
| ***F04C 18/06*** | (2006.01) |
| ***F04C 28/26*** | (2006.01) |
| ***F01C 1/16*** | (2006.01) |

(56) References Cited

U.S. PATENT DOCUMENTS

| | | | | |
|---|---|---|---|---|
| 4,609,329 | A | 9/1986 | Pillis et al. | |
| 5,393,209 | A * | 2/1995 | Mohr | F01C 1/082 418/152 |
| 5,904,473 | A * | 5/1999 | Dahmlos | F01C 21/02 417/410.4 |
| 10,359,043 | B2 * | 7/2019 | Miyatake | F04C 29/02 |
| 2001/0041280 | A1 | 11/2001 | Mori et al. | |
| 2012/0039737 | A1 | 2/2012 | Birch et al. | |
| 2015/0030490 | A1 * | 1/2015 | Beekman | F01C 21/02 418/201.1 |
| 2015/0240810 | A1 * | 8/2015 | Metz | F04C 3/085 418/201.1 |

FOREIGN PATENT DOCUMENTS

| | | | | |
|---|---|---|---|---|
| CN | 102395793 | A | 3/2012 | |
| CN | 104863847 | A | 8/2015 | |
| CN | 107076146 | A | 8/2017 | |
| EP | 0828079 | A2 | 3/1998 | |
| GB | 464476 | A * | 10/1935 | F01C 1/088 |
| WO | 2010008457 | A2 | 1/2010 | |

OTHER PUBLICATIONS

Written Opinion of the International Searching Authority; International Application No. PCT/US2018/057125; International Filing Date: Oct. 23, 2018; dated Mar. 14, 2019; 9 pages.

First Chinese Office Action; Chinese Application No. 201880069614.1; dated Oct. 26, 2021; 12 pages.

Chinese Office Action; Chinese Application No. 201880069614.1; dated Apr. 1, 2022; 6 pages.

European Office Action; European Application No. 18800412.1; dated Mar. 9, 2022; 6 pages.

n

* cited by examiner

INTERNAL DISCHARGE GAS PASSAGE FOR COMPRESSOR

CROSS REFERENCE TO RELATED APPLICATIONS

This application is a National Stage application of PCT/US2018/057125, filed Oct. 23, 2018, which claims priority to U.S. Provisional Application No. 62/577,001 filed Oct. 25, 2017, both of which are incorporated by reference in their entirety herein.

BACKGROUND

The subject matter disclosed herein relates generally to fluid machines, and more specifically, to fluid machines, such as compressors, having helically lobed rotors.

It has been determined that commonly used refrigerants, such as R-410A in one non-limiting example, have unacceptable global warming potential (GWP) such that their use will cease for many HVAC&R applications. Non-flammable, low GWP refrigerants are replacing existing refrigerants in many applications, but have lower density and do not possess the same cooling capacity as existing refrigerants. Replacement refrigerants require a compressor capable of providing a significantly greater displacement, such as a screw compressor.

Existing screw compressors typically utilize roller, ball, or other rolling element bearings to precisely position the rotors and minimize friction during high speed operation. However, for typical HVAC&R applications, existing screw compressors with roller element bearings result in an unacceptably large and costly fluid machine.

Therefore, there exists a need in the art for an appropriately sized and cost effective fluid machine that minimizes friction while allowing precise positioning and alignment of the rotors.

BRIEF DESCRIPTION

According to one embodiment, a compressor casing having an internal gas passage includes a first bearing housing arranged at a first end of the casing, a second bearing housing arranged at a second, opposite end of the casing, and a rotor case disposed between the first bearing housing and the second bearing housing. The rotor case includes an axially extending bore within which a plurality of rotors are receivable and a hollow internal cavity isolated from the bore. The internal cavity is fluidly coupled to the bore via at least one recess. At least one exit opening is formed in one of the first bearing housing and the second bearing housing. The at least one exit opening is operably coupled to the internal cavity of the rotor case.

In addition to one or more of the features described above, or as an alternative, in further embodiments at least one of the first bearing housing and the second bearing housing includes the at least one recess fluidly coupling the bore to the internal cavity.

In addition to one or more of the features described above, or as an alternative, in further embodiments the first bearing housing includes a first recess and the second bearing housing includes a second recess.

In addition to one or more of the features described above, or as an alternative, in further embodiments the at least one recess is formed in the rotor case.

In addition to one or more of the features described above, or as an alternative, in further embodiments the at least one exit opening includes a plurality of exit openings.

In addition to one or more of the features described above, or as an alternative, in further embodiments each of the plurality of exit openings has a substantially identical configuration.

In addition to one or more of the features described above, or as an alternative, in further embodiments the plurality of exit openings is distributed about a periphery of one of the first bearing housing and the second bearing housing.

In addition to one or more of the features described above, or as an alternative, in further embodiments the plurality of exit openings is arranged about one of the first bearing housing and the second bearing housing such that compressed refrigerant output from the plurality of exit openings is uniformly distributed.

In addition to one or more of the features described above, or as an alternative, in further embodiments the at least one exit opening is formed in the second bearing housing, the second bearing housing further comprising an internal chamber arranged in fluid communication with the internal cavity of the rotor case.

In addition to one or more of the features described above, or as an alternative, in further embodiments the at least one exit opening includes a plurality of exit openings and the internal chamber distributes compressed refrigerant from the internal cavity to each of the plurality of exit openings.

In addition to one or more of the features described above, or as an alternative, in further embodiments the second bearing housing further comprises a fluid passageway extending between the internal cavity and the internal chamber.

According to another embodiment, a fluid machine includes a first rotor rotatable about a first axis, a second rotor rotatable about a second axis, a motor for driving rotation of at least one of the first rotor and the second rotor, and a casing for rotatably supporting at least one of the first rotor and the second rotor. The casing includes an internal gas passage for discharging refrigerant compressed between the first rotor and the second rotor from an end of the casing over an exterior surface of the motor.

In addition to one or more of the features described above, or as an alternative, in further embodiments the discharged refrigerant is uniformly distributed about the exterior surface of the motor.

In addition to one or more of the features described above, or as an alternative, in further embodiments the casing further comprises: a first bearing housing arranged at a first end of the casing, a second bearing housing arranged at a second, opposite end of the casing, and a rotor case disposed between the first bearing housing and the second bearing housing. The rotor case includes an axially extending bore within which the first rotor and the second rotor are positioned and a hollow internal cavity isolated from the bore. The internal cavity is fluidly coupled to the bore via at least one recess.

In addition to one or more of the features described above, or as an alternative, in further embodiments the casing further comprises at least one exit opening formed in one of the first bearing housing and the second bearing housing adjacent the motor, the at least one exit opening being operably coupled to the internal cavity of the rotor case.

In addition to one or more of the features described above, or as an alternative, in further embodiments the at least one exit opening includes a plurality of exit openings.

In addition to one or more of the features described above, or as an alternative, in further embodiments the one of the first bearing housing and the second bearing housing includes an internal chamber for distributing compressed refrigerant from the internal cavity to the at least one exit opening.

In addition to one or more of the features described above, or as an alternative, in further embodiments at least one of the first bearing housing and the second bearing housing includes the at least one recess fluidly coupling the bore to the internal cavity.

In addition to one or more of the features described above, or as an alternative, in further embodiments the rotor case includes the at least one recess fluidly coupling the bore to the internal cavity.

In addition to one or more of the features described above, or as an alternative, in further embodiments the first rotor and the second rotor have helical lobes arranged in intermeshing engagement.

BRIEF DESCRIPTION OF THE DRAWINGS

The subject matter, which is regarded as the disclosure, is particularly pointed out and distinctly claimed in the claims at the conclusion of the specification. The foregoing and other features, and advantages of the disclosure are apparent from the following detailed description taken in conjunction with the accompanying drawings in which:

The detailed description explains embodiments of the disclosure, together with advantages and features, by way of example with reference to the drawings.

DETAILED DESCRIPTION

Figure 1:
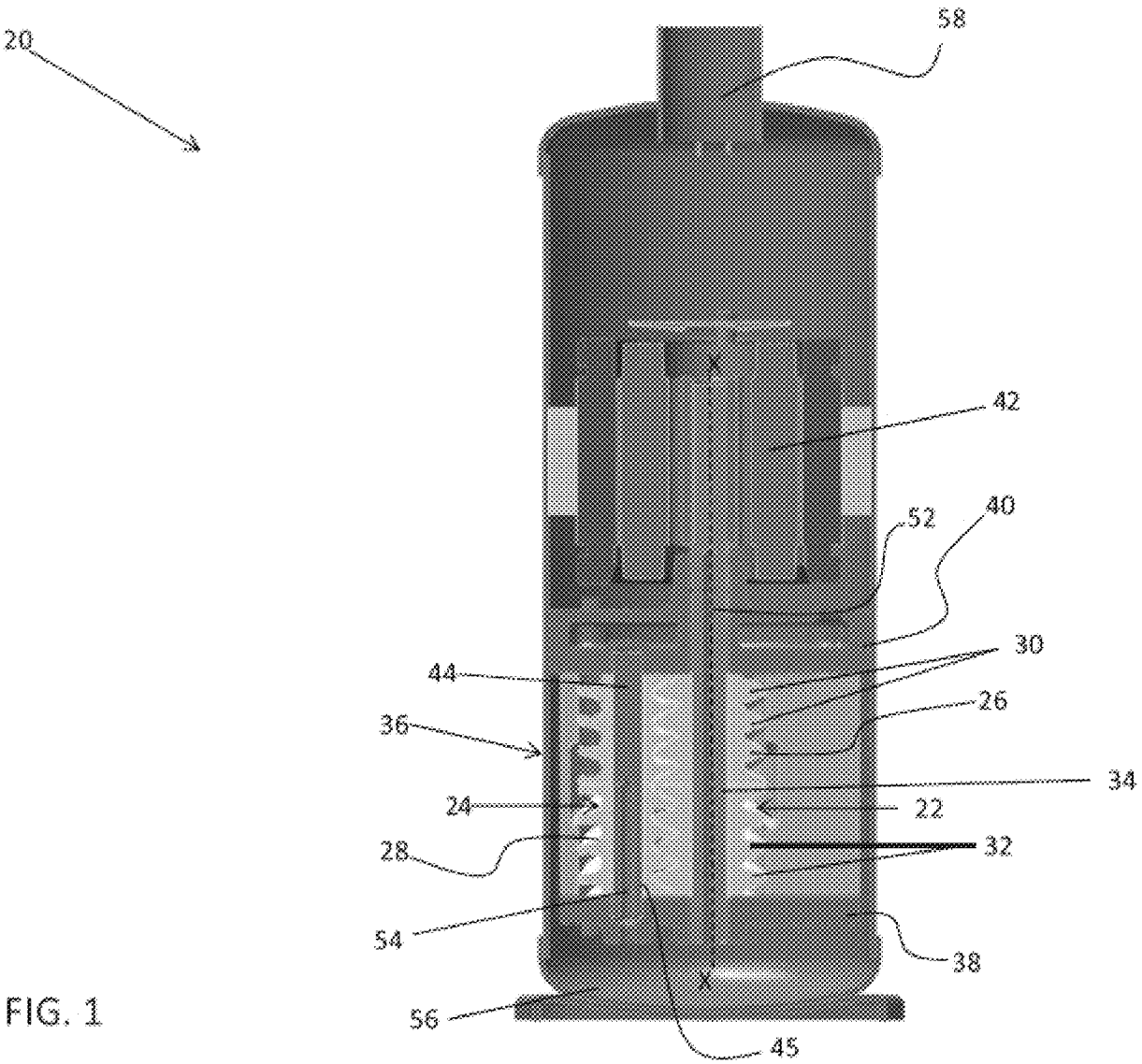
FIG. 1 is cross-sectional view of a fluid machine according to an embodiment.
Figure 2:
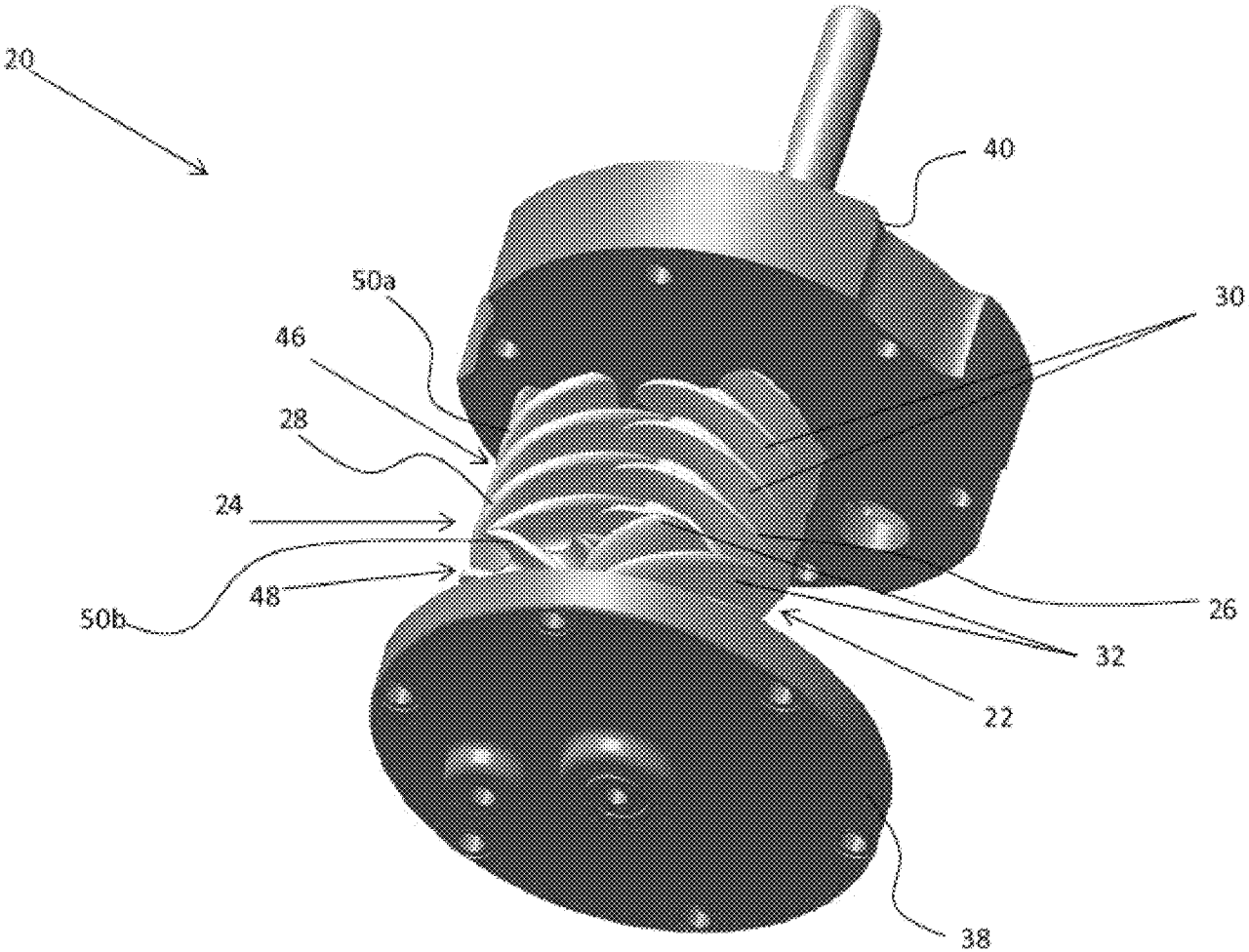
FIG. 2 is a perspective view of a fluid machine according to an embodiment.

Referring now to the FIGS. 1 and 2, a fluid machine 20 is illustrated. In the illustrated, non-limiting embodiment, the fluid machine 20 is an opposed screw compressor. However, other suitable embodiments of a fluid machine, such as a pump, fluid motor, or engine for example, are also within the scope of the disclosure. The fluid machine 20 includes a first rotor 22 intermeshed with a second rotor 24. In an embodiment, the first rotor 22 is a male rotor having a male-lobed working portion 26 and the second rotor 24 is a female rotor including a female-lobed portion 28. Alternatively, the first rotor 22 may be a female rotor and the second rotor 24 may be a male rotor. The working portion 26 of the first rotor 22 includes at least one first helical lobe 30 and at least one second helical lobe 32. In the illustrated, non-limiting embodiment, the first rotor 22 includes two separate portions defining the first helical lobes 30 and the second helical lobes 32. In another embodiment, the first rotor 22, including the first and second helical lobes 30, 32, may be formed as a single integral piece.

The fluid machine 20 includes a first shaft 34 fixed for rotation with the first rotor 22. The fluid machine 20 further include a casing 36 rotatably supporting the first shaft 34 and at least partially enclosing the first rotor 22 and the second rotor 24. A first end 38 and a second end 40 of the casing 36 are configured to rotatably support the first shaft 34. The first shaft 34 of the illustrated embodiments is directly coupled to an electric motor 42 operable to drive rotation of the first shaft 34 about an axis X. Any suitable type of electric motor 42 is contemplated herein, including but not limited to an induction motor, permanent magnet (PM) motor, and switch reluctance motor for example. In an embodiment, the first rotor 22 is fixed to the first shaft 34 by a fastener, coupling, integral formation, interference fit, and/or any additional structures or methods known to a person having ordinary skill in the art (not shown), such that the first rotor 22 and the first shaft 34 rotate about axis X in unison.

The fluid machine 20 additionally includes a second shaft 44 operable to rotationally support the second rotor 24. The second rotor 24 includes an axially extending bore 45 within which the second shaft 44 is received. In an embodiment, the second shaft 44 is stationary or fixed relative to the casing 36 and the second rotor 24 is configured to rotate about the second shaft 44. However, embodiments where the second shaft 44 is also rotatable relative to the casing 36 are also contemplated herein.

With specific reference to FIG. 2, the first rotor 22 is shown as including four first helical lobes 30 and four helical lobes 32. The illustrated, non-limiting embodiment, is intended as an example only, and it should be understood by a person of ordinary skill in the art that any suitable number of first helical lobes 30 and second helical lobes 32 are within the scope of the disclosure. As shown, the first helical lobes 30 and the second helical lobes 32 have opposite helical configurations. In the illustrated, non-limited embodiment, the first helical lobes 30 are left-handed and the second helical lobes 32 are right-handed. Alternatively, the first helical lobes 30 may be right-handed and the second helical lobes 32 may be left-handed.

By including lobes 30, 32 with having opposite helical configurations, opposing axial flows are created between the first and second helical lobes 30, 32. Due to the symmetry of the axial flows, thrust forces resulting from the helical lobes 30, 32 are generally equal and opposite, such that the thrust forces substantially cancel one another. As a result, this configuration of the opposing helical lobes 30, 32 provides a design advantage since the need for thrust bearings in the fluid machine can be reduced or eliminated.

The second rotor 24 has a first portion 46 configured to mesh with the first helical lobes 30 and a second portion 48 configured to mesh with the second helical lobes 32. To achieve proper intermeshing engagement between the first rotor 22 and the second rotor 24, each portion 46, 48 of the second rotor 24 includes one or more lobes 50 having an opposite configuration to the corresponding helical lobes 30, 32 of the first rotor 22. In the illustrated, non-limiting embodiment, the first portion 46 of the second rotor 24 has at least one right-handed lobe 50*a*, and the second portion 48 of the second rotor 24 includes at least one left-handed lobe 50*b*.

In an embodiment, the first portion 46 of the second rotor 24 is configured to rotate independently from the second portion 48 of the second rotor 24. However, embodiments where the first and second portions 46, 48 are rotationally coupled are also contemplated herein. Each portion 46, 48 of the second rotor 24 may include any number of lobes 50. In an embodiment, the total number of lobes 50 formed in each portion 46, 48 of the second rotor 24 is generally larger than a corresponding portion of the first rotor 22. For example, if the first rotor 22 includes four first helical lobes 30, the first portion 46 of the second rotor 24 configured to intermesh with the first helical lobes 30 may include five helical lobes 50*a*. However, embodiments where the total number of lobes 50 in a portion 46, 48 of the second rotor 24 is equal to a corresponding group of helical lobes (i.e. the first helical lobes 30 or the second helical lobes 32) of the first rotor 22 are also within the scope of the disclosure.

Returning to FIG. 1, the fluid machine 20 may include a first shaft passage 52 extending axially through the first shaft 34 and a second shaft passage 54 extending axially through the second shaft 44. The first shaft passage 52 and/or the second shaft passage 54 communicate lubricant from a sump 56, through first shaft 34 and/or second shaft 44, out one or more radial passages (not shown), and along one or more surfaces of the first rotor 22 and/or the second rotor 24. The fluid machine 20 further includes an axially-extending passage 45 defined between the second shaft 44 and the bore formed in the second rotor 24. The passage 45 is configured to allow lubricant to pass or circulate there through. In an embodiment, relatively high pressure discharge at first and second ends 38, 40 of the casing 36, the first rotor 22, and the second rotor 24 and relatively low pressure suction at a central location of the first rotor 22 and the second rotor 24 urge lubricant through the passage 45. The circulation of lubricant through the passage 45 provides internal bearing surfaces between each of the first and second portions 46, 48 and the second shaft 44 to reduce friction there between and further allow the first portion 46 of the second rotor 24 to rotate independently of the second portion 48 of the second rotor 24.

During operation of the fluid machine 20 of one embodiment, a gas or other fluid, such as a low GWP refrigerant for example, is drawn to a central location by a suction process generated by the fluid machine 20. Rotation of the first rotor 22 and the second rotor 24 compresses the refrigerant and forces the refrigerant toward first and second ends 38, 40 of the casing 36 between the sealed surfaces of the meshed rotors 22, 24 due to the structure and function of the opposing helical rotors 22, 24. The compressed refrigerant is routed by an internal gas passage within the casing 36 and discharged through the second end 40 of the casing 36. The discharged refrigerant passes through the electric motor 42 and out of the passage 58.

Figure 3:
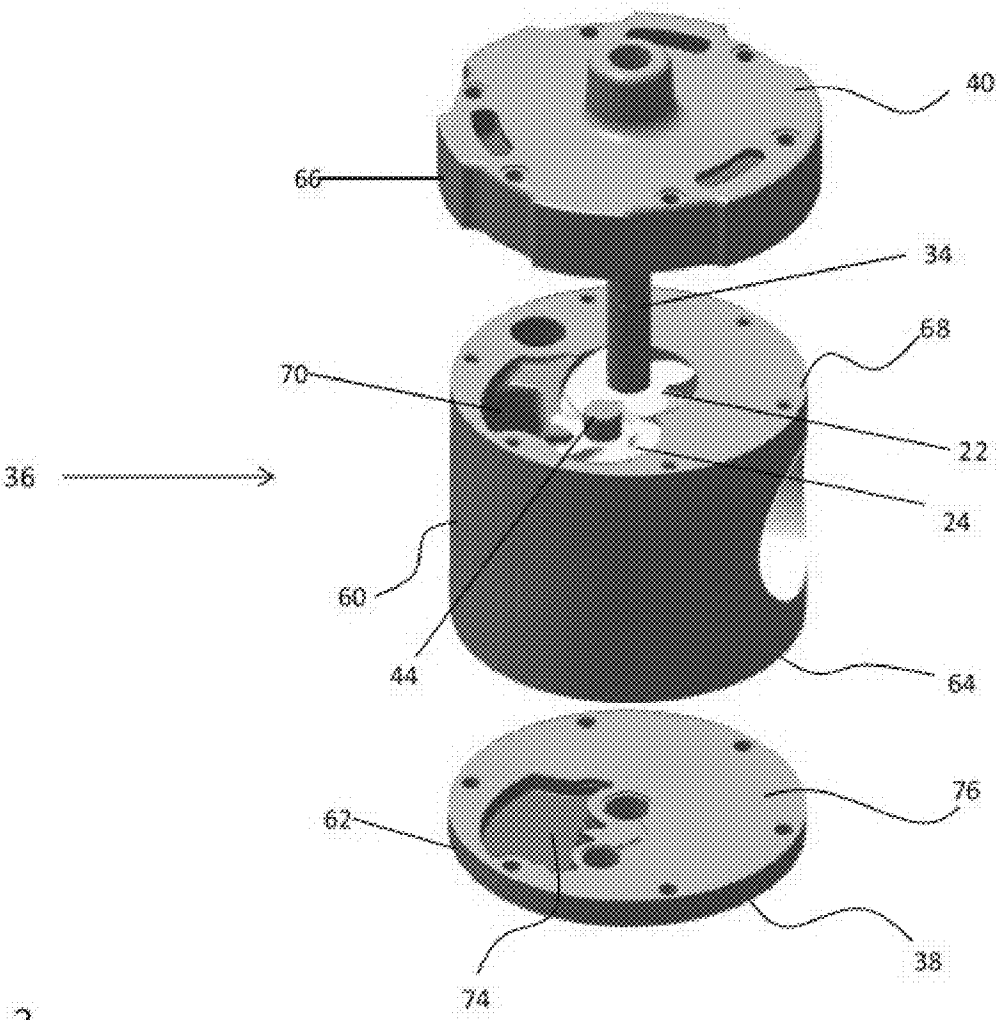
FIG. 3 is an exploded perspective view of a casing of a fluid a machine according to an embodiment.
Figure 5:
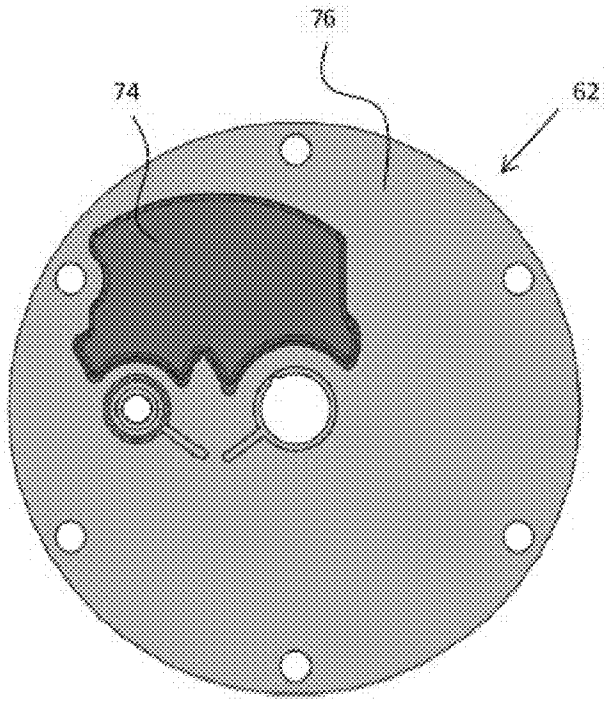
FIG. 5 is a top view of a lower bearing housing according to an embodiment.
Figure 4:
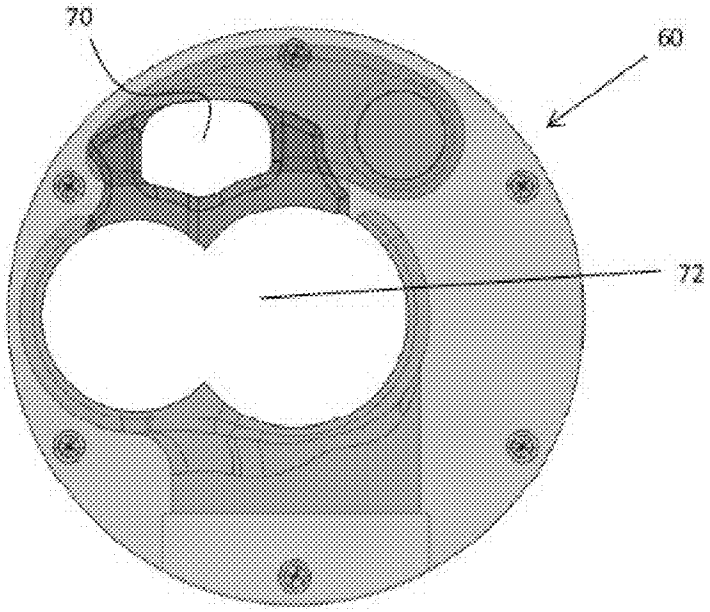
FIG. 4 is a top view of a rotor case according to an embodiment.

With reference now to FIGS. 3-7, the internal gas passage of the casing 36 is illustrated in more detail. As best shown in FIG. 3, the casing 36 includes a rotor case 60, a lower bearing housing 62 arranged adjacent a first end 64 of the rotor case 60 to form the first (lower) end 38 of the casing 36. Similarly, an upper bearing housing 66 is arranged adjacent a second, opposite end 68 of the rotor case 60 and forms the second (upper) end 40 of the casing 36. The rotor case 60 includes a hollow chamber or internal cavity 70 separate from the bore 72 configured to receive the male and female rotors 22, 24.

In an embodiment, a first recess 74 is formed in a surface 76 of the lower bearing housing 62 adjacent the rotor case 60. The first recess 74 is sized, shaped, and positioned to fluidly couple the internal cavity 70 to a first end of the bore 72 housing the rotors 22, 24. Similarly, a second recess 78 (FIG. 6A) may be formed in the surface 80 of the upper bearing housing 66 facing the rotor case 60. The second recess 78 is sized, shaped and positioned to fluidly couple the internal cavity 70 to a second, opposite end of the cavity 72 housing the rotors 22, 24. In an embodiment, the first recess 74 and the second recess 78 are substantially identical in shape. However, embodiments where the first recess 74 and the second recess 78 have different configurations are also within the scope of the disclosure. Further, it should be understood that the depth of both the first recess 74 and the second recess 78 is less than a thickness of the lower bearing housing 62 and the upper bearing housing 66, respectively. As a result, the first and second recesses 74, 78 do not provide a means for refrigerant to escape from the casing 36.

Figure 8:
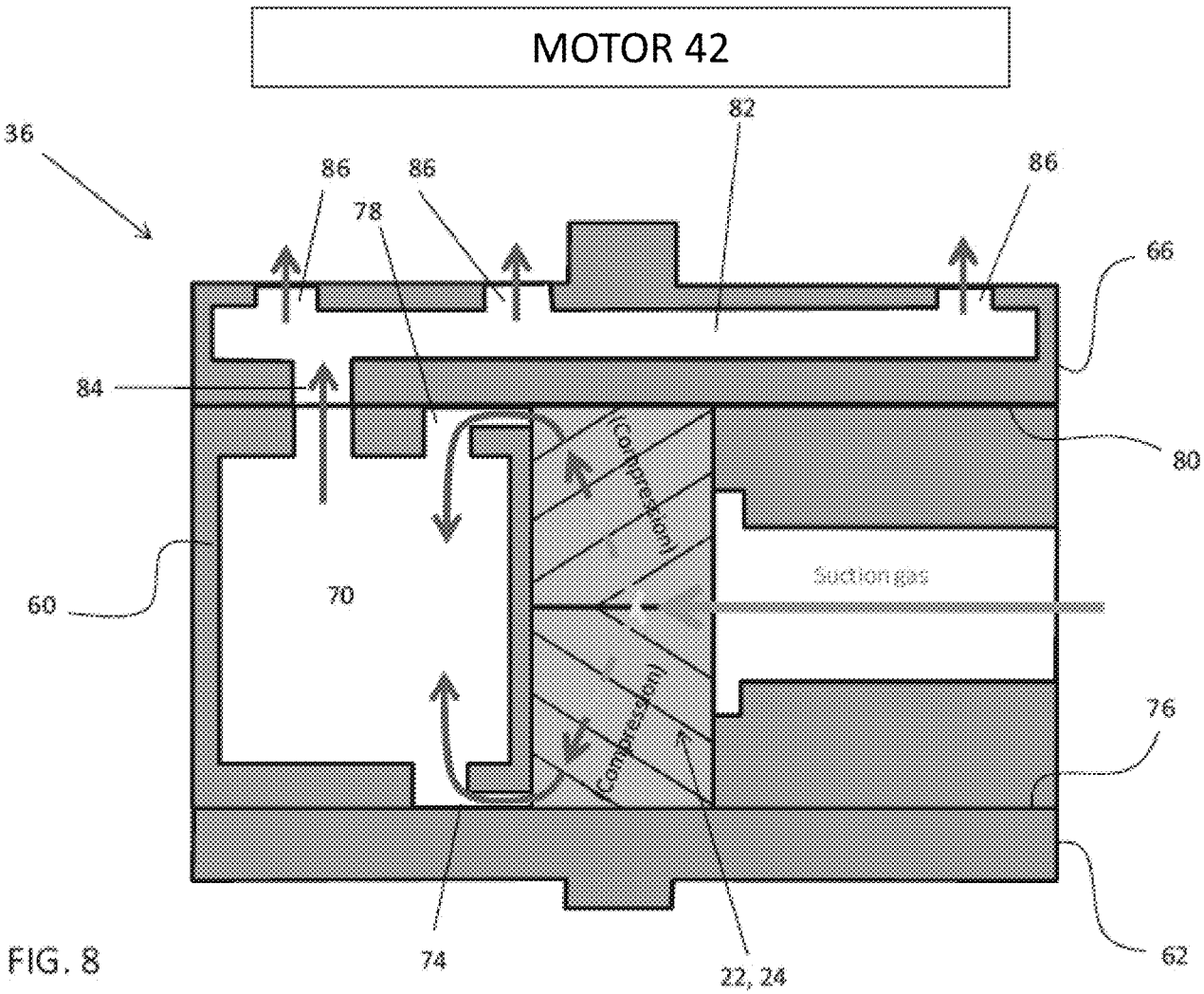
FIG. 8 is a cross-sectional view of a casing of a fluid machine according to another embodiment.

With reference now to FIG. 8, in another embodiment, at least one of the first recess 74 and the second recess 78 fluidly coupling the compression pocket including the first and second rotors 22, 24 to the hollow internal chamber 82 is formed in a portion of the rotor case 60. As shown, the first and second recess 74, 78 are formed at the distal ends, 64, 68 of the rotor case 60 such that the lower and upper bearing housings 64, 66 define a wall adjacent of the recess 74, 78.

Figure 6A:
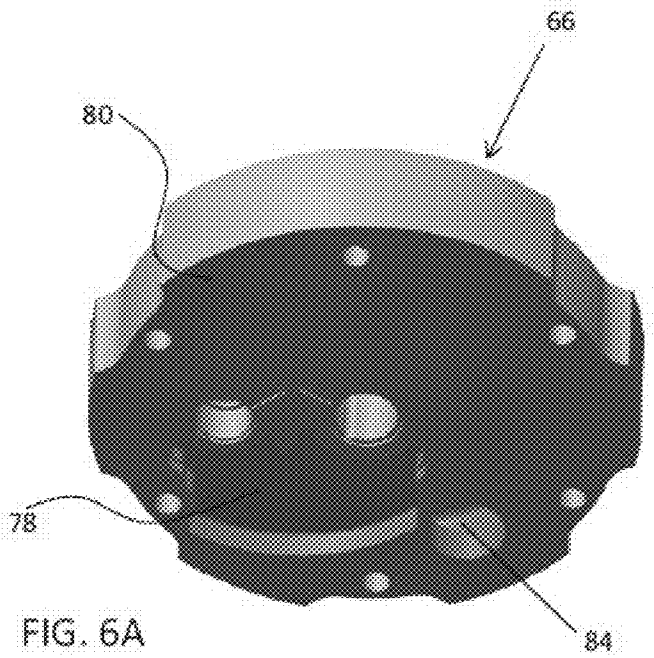
FIG. 6A is a perspective view of an upper bearing housing according to an embodiment.
Figure 6B:
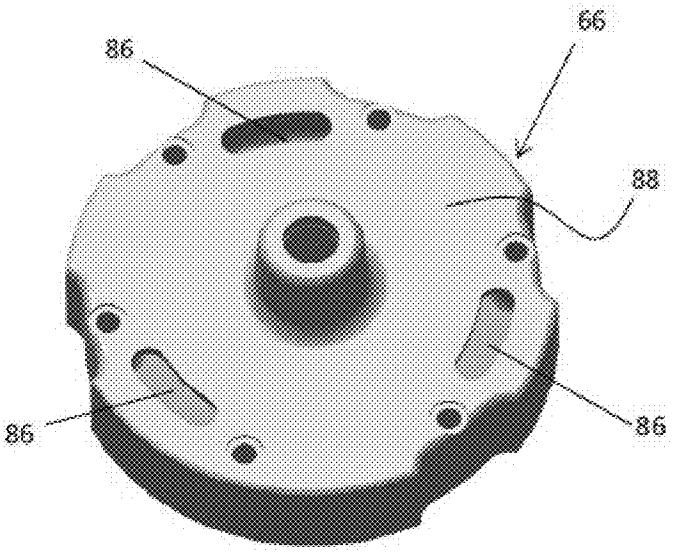
FIG. 6B is another perspective view of an upper bearing housing according to an embodiment.
Figure 7:
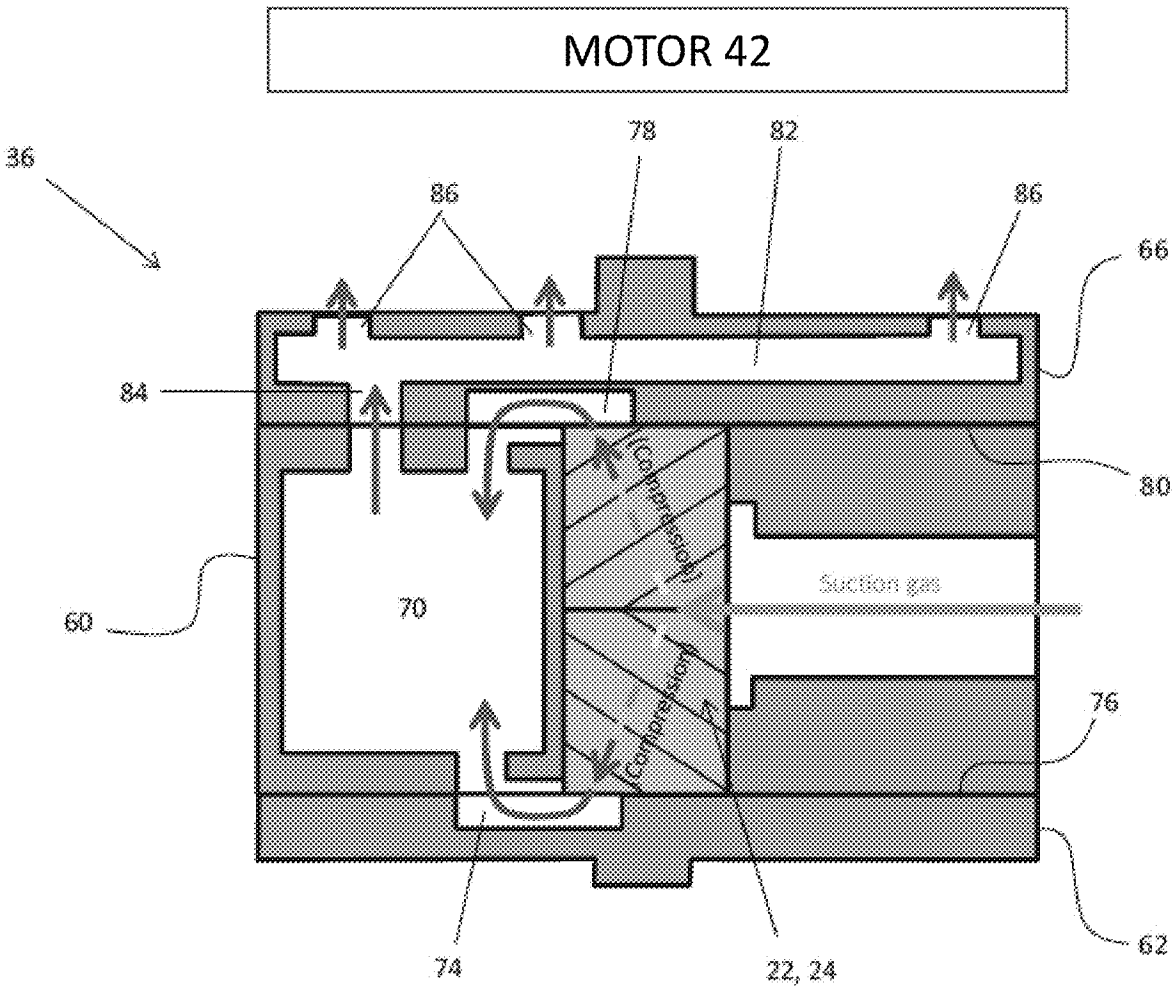
FIG. 7 is a cross-sectional view of a casing of a fluid machine according to an embodiment.

As best shown in FIGS. 6 and 7, the upper bearing housing 66 additionally includes hollow internal chamber 82 operably coupled to the internal cavity 70 of the rotor case 60 by a fluid passageway 84. At least one exit opening 86 is formed in an outer surface 88 of the upper bearing housing 66 and is arranged in fluid communication with the hollow internal chamber 82. In the illustrated, non-limiting embodiment, the at least one exit opening 86 includes three exit openings, having a slot-like configuration. However, any suitable number of exit openings 86 is within the scope of the disclosure. Further, although each of the plurality of the exit openings 86 is shown having a substantially identical configuration, in other embodiment, the exit openings 86 may vary in size and shape.

In embodiments where the upper bearing housing 66 includes multiple exit openings 86, each of the exit openings 86 is arranged at a distinct location such that the plurality of exit openings 86 is distributed over the outer surface 88 of the upper bearing housing 66. In an embodiment, the exit openings 86 are equidistantly spaced about a periphery of the upper bearing housing 66 such that the compressed refrigerant expelled from the exit openings 86 uniformly cools an exterior surface of the electric motor 42. However, the exit openings 86 may be formed at any location of the outer surface of the upper bearing housing.

As the male and female rotors 22, 24 rotate about their respective axes, at least a portion of the refrigerant compressed between the rotors 22, 24 is pushed towards the lower bearing housing 62 and into the first recess 74. Similarly, a portion of the compressed refrigerant is pushed towards the upper bearing housing 66 and into the second recess 78. Due to the pressure generated by the continued operation of the fluid machine 20, the compressed refrigerant is forced from the first and second recess 74, 78 into the internal cavity 70 of the rotor case 60. From the internal cavity 70, the compressed refrigerant flows through the fluid passage 84 and into the hollow internal chamber 82 formed in the upper bearing housing 66. Within the internal chamber 82, the refrigerant is distributed to each of the exit openings 86. Once discharged from the exit opening 86, the compressed refrigerant interacts with an outer surface of a portion of the motor 42, thereby cooling the motor 42.

A compressor as described herein provides an internal discharge passage for cooling the motor 42 while minimizing the total number of components required for the rotor casing 36. By effectively utilizing the space within each component, the overall size of the compressor can be reduced.

While the disclosure has been described in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that aspects of the disclosure may include only some of the described embodiments. Accordingly, the disclosure is not to be seen as limited by the foregoing description, but is only limited by the scope of the appended claims.

What is claimed is:

1. A compressor casing having an internal gas passage comprising:

a first bearing housing arranged at a first end of the casing;

a second bearing housing arranged at a second, opposite end of the casing;

a rotor case disposed between the first bearing housing and the second bearing housing, the rotor case including an axially extending bore within which a plurality of rotors are receivable and a hollow internal cavity isolated from the bore, wherein the internal cavity is fluidly coupled to the bore via at least one recess; and a plurality of exit openings formed in one of the first bearing housing and the second bearing housing, the plurality of exit openings being operably coupled to the internal cavity of the rotor case.

2. The compressor casing of claim 1, wherein at least one of the first bearing housing and the second bearing housing includes the at least one recess fluidly coupling the bore to the internal cavity.

3. The compressor casing of claim 2, wherein the first bearing housing includes a first recess and the second bearing housing includes a second recess.

4. The compressor casing of claim 1, wherein the at least one recess is formed in the rotor case.

5. The compressor casing of claim 1, wherein each of the plurality of exit openings has a substantially identical configuration.

6. The compressor casing of claim 1, wherein the plurality of exit openings is distributed about a periphery of one of the first bearing housing and the second bearing housing.

7. The compressor casing of claim 1, wherein the plurality of exit openings is arranged about one of the first bearing housing and the second bearing housing such that compressed refrigerant output from the plurality of exit openings is uniformly distributed.

8. The compressor casing of claim 1, wherein the plurality of exit openings are formed in the second bearing housing, the second bearing housing further comprising an internal chamber arranged in fluid communication with the internal cavity of the rotor case.

9. The compressor casing of claim 8, wherein the plurality of exit openings and the internal chamber distributes compressed refrigerant from the internal cavity to each of the plurality of exit openings.

10. The compressor casing of claim 8, wherein the second bearing housing further comprises a fluid passageway extending between the internal cavity and the internal chamber.

11. A fluid machine comprising:

a first rotor rotatable about a first axis;

a second rotor rotatable about a second axis;

a motor for driving rotation of at least one of the first rotor and the second rotor; and a casing for rotatably supporting at least one of the first rotor and the second rotor, the casing including an internal gas passage for discharging refrigerant compressed between the first rotor and the second rotor from an end of the casing over an exterior surface of the motor, the casing further comprising:

a first bearing housing arranged at a first end of the casing;

a second bearing housing arranged at a second, opposite end of the casing; and a rotor case disposed between the first bearing housing and the second bearing housing, the rotor case including an axially extending bore within which the first rotor and the second rotor are positioned and a hollow internal cavity isolated from the bore, wherein the internal cavity is fluidly coupled to the bore via at least one recess.

12. The fluid machine of claim 11, wherein the discharged refrigerant is uniformly distributed about the exterior surface of the motor.

13. The fluid machine of claim 11, wherein the casing further comprises at least one exit opening formed in one of the first bearing housing and the second bearing housing adjacent the motor, the at least one exit opening being operably coupled to the internal cavity of the rotor case.

14. The fluid machine of claim 13, wherein the at least one exit opening includes a plurality of exit openings.

15. The fluid machine of claim 13, wherein the one of the first bearing housing and the second bearing housing includes an internal chamber for distributing compressed refrigerant from the internal cavity to the at least one exit opening.

16. The fluid machine of claim 11, wherein at least one of the first bearing housing and the second bearing housing includes the at least one recess fluidly coupling the bore to the internal cavity.

17. The fluid machine of claim 16, wherein the rotor case includes the at least one recess fluidly coupling the bore to the internal cavity.

18. The fluid machine of claim 11, wherein the first rotor and the second rotor have helical lobes arranged in intermeshing engagement.

19. A compressor casing having an internal gas passage comprising:

a first bearing housing arranged at a first end of the casing;

a second bearing housing arranged at a second, opposite end of the casing;

a rotor case disposed between the first bearing housing and the second bearing housing, the rotor case including an axially extending bore within which a plurality of rotors are receivable and a hollow internal cavity isolated from the bore, wherein the internal cavity is fluidly coupled to the bore via at least one recess formed in the rotor case; and at least one exit opening formed in one of the first bearing housing and the second bearing housing, the at least one exit opening being operably coupled to the internal cavity of the rotor case.

* * * * *